United States Patent [19]

Melby et al.

[11] Patent Number: 4,565,196

[45] Date of Patent: Jan. 21, 1986

[54] DISPOSABLE SMOKE MASK AND APPARATUS

[75] Inventors: Phillip J. Melby; James J. Koch, both of Mason City, Iowa

[73] Assignee: Melco Co Inc., Mason City, Iowa

[21] Appl. No.: 668,387

[22] Filed: Nov. 5, 1984

[51] Int. Cl.[4] ..... A62B 9/02

[52] U.S. Cl. ..... 128/205.24; 128/205.25

[58] Field of Search ..... 128/204.18, 205.24, 128/205.25, 206.21, 206.28; 102/334

[56] References Cited

U.S. PATENT DOCUMENTS

| | | | |
|---|---|---|---|
| 2,860,634 | 11/1958 | Duncan et al. | 128/205.24 |
| 3,316,907 | 5/1967 | Goupel | 128/205 |
| 4,090,509 | 5/1978 | Smith | 128/142.5 |
| 4,098,271 | 7/1978 | Maddock | 128/142.3 |
| 4,271,833 | 6/1981 | Moretti | 128/201.29 |
| 4,365,628 | 12/1982 | Hodel | 128/205.24 |
| 4,373,522 | 2/1983 | Zien | 128/206.12 |
| 4,423,723 | 1/1984 | Winkler | 128/202.22 |
| 4,440,163 | 4/1984 | Spergel | 128/205.13 |

*Primary Examiner*—Kyle L. Howell
*Assistant Examiner*—Daniel A. Haneiwich
*Attorney, Agent, or Firm*—Robert T. Johnson

[57] ABSTRACT

A disposable smoke mask and apparatus comprising breathable gas or air contained under pressure in the canister and connected by a hose to the mask, and wherein breathable gas contained in the canister is released to the hose by means of a valve actuated by removal of a snap ring section to allow a spring under compression to actuate a plunger unit tube, to allow breathable gas to flow through a suitable orifice into the plunger unit tube and through another orifice in the top of the plunger unit tube, and the hose and into the mask.

1 Claim, 5 Drawing Figures

DISPOSABLE SMOKE MASK AND APPARATUS

BACKGROUND OF INVENTION

This invention for a disposable smoke mask and apparatus covers a readily mounted smoke mask, and apparatus connected thereto by means of a flexible tube or hose which hose is connected on one end to a smoke mask, and the other end connected to a container or canister containing breathable gas under compression comprising air or oxygen mixed with other gases.

There are many instances when a person is caught in a burning building, such as a house, apartment or hotel, and becomes asphyxiated due to inhaling the gases generated in such burning building. Often the need for breathable air is of short duration of from about 2 to 10 minutes, during which time escape from the burning building could be accomplished.

DESCRIPTION OF BACKGROUND ART

U.S. Pat. No. 4,090,509 to Smith for "Vital Emergency Survival Time (Vest)". This patent discloses a garment comtaining small diameter tubing, and a shielding layer protects the user against injury should the tubing rupture. A breathing mask covering the whole face is disclosed.

U.S. Pat. No. 4,098,271 to Maddock for "Oxygen Supply System And Flow Indicator". This discloses a flow indicator of oxygen supplied to passengers in an air craft.

U.S. Pat. No. 4,440,163 to Spergel for "Emergency Escape Breathing Apparatus". This comprises apparatus having a valve and a rupturable disc to allow flow of breathable gas from a bottle supply to the mask. This differs from the present Melby disclosure in view of the rupturable disc, full face mask and regulating chamber of Spergel.

The valve in this Spergel patent could be twisted off or turned in the wrong direction, in a panic situation, in which case the valve could not be opened.

U.S. Pat. No. 4,423,723 to Winkler et al. for "Closed Cycle Respirator With Emergency Oxygen Supply". This patent speaks of a closed cycle backpack respirator for underwater work. The present disclosure of Melby, et al. application differs from the disclosure of this patent in that the patent discloses a closed cycle.

U.S. Pat. No. 4,271,833 to Moretti for "Ventilating System For Protective Clothing". A ventilating system is disclosed for protective clothing on the user's body.

U.S. Pat. No. 4,373,522 to Zien for "Emergency Fresh Air Supply Device". This discloses a mask connected through tubing to fresh air supplied through a conduit extending through the building wall to the outside. Air to the mask is not under positive pressure.

U.S. Pat. No. 3,316,907 to Goupil for "Superoxygenated Air Inhaling Device". The disclosure in this patent speaks of mixing oxygen with air fed into a mask for inhalation by the user.

In the above background art cited, there is no disclosure showing supplying breathable air to a person, in a self-contained system comprising only a canister containing the breathable gas and a mask fitting over only the mouth and nose, not the eyes.

The whole apparatus of this invention is portable, readily usable and disposable after a single use.

The problems encountered with smoke masks in background art apparatus is that a whole face mask quickly fogs over on the inside thus causing a problem of seeing through such fogged mask; in addition, there is no disclosure of a canister containing breathable gas wherein the valve to supply the gas is actuated by a spring that does not rely on turning a hand wheel to release the gas for flow to the mask.

The valve actuation mechanism of this Melby et al. application is foolproof in that all that is required is pulling a snap ring section pull handle to remove a snap ring section to release a compressed spring to actuate the release of breathable gas to a hose and into a mask covering only the nose and mouth.

SUMMARY OF THE INVENTION

This invention discloses a face mask fitting over the nose and mouth of a wearer, said mask is held in position by a suitable elastic strap. The mask is connected to a canister containing breathable air or suitable gases.

A canister containing breathable air-gas, hereinafter called "gas" is connected to a face mask by a suitable hose or duct. The seal of the canister is readily opened to allow the gas to flow through the hose and into the mask, for breathing by the person wearing said mask.

An object of this invention is to disclose a disposable smoke mask and apparatus wherein the mask is connected to one end of a hose or tube and the other end of said hose is connected to a canister aperture feeding breathable gas into the hose.

Another object of this invention is to disclose a disposable smoke mask and apparatus comprising a canister containing breathable gas, and a canister valve, means for opening said canister valve to allow said gas to flow from the canister in the hose feeding into the mask.

Another object of this invention is to disclose a canister and valve contained therein wherein said valve comprises a spring held plunger unit tube and said plunger unit tube is held in closed position by a snap ring section to hold said plunger unit against a spring under compression.

Another object of this invention is to disclose a disposable smoke mask and apparatus comprising breathable gas or air contained under pressure in a canister and connected by a hose to said mask, and wherein breathable gas contained in said canister is released from said canister to said hose by means of a valve comprising a plunger unit tube actuated by removal of a snap ring section to allow a spring under compression to actuate said plunger unit tube, and said breathable gas to flow through an aperture in the inner wall of said canister and into an aperture in said plunger unit tube and out of said plunger unit tube through an aperture into said hose and into said mask.

BRIEF DESCRIPTION OF THE DRAWINGS

FIG. 1. This is an elevation view of internal mechanism of the canister containing the breathable gas wherein:

Figure 1:
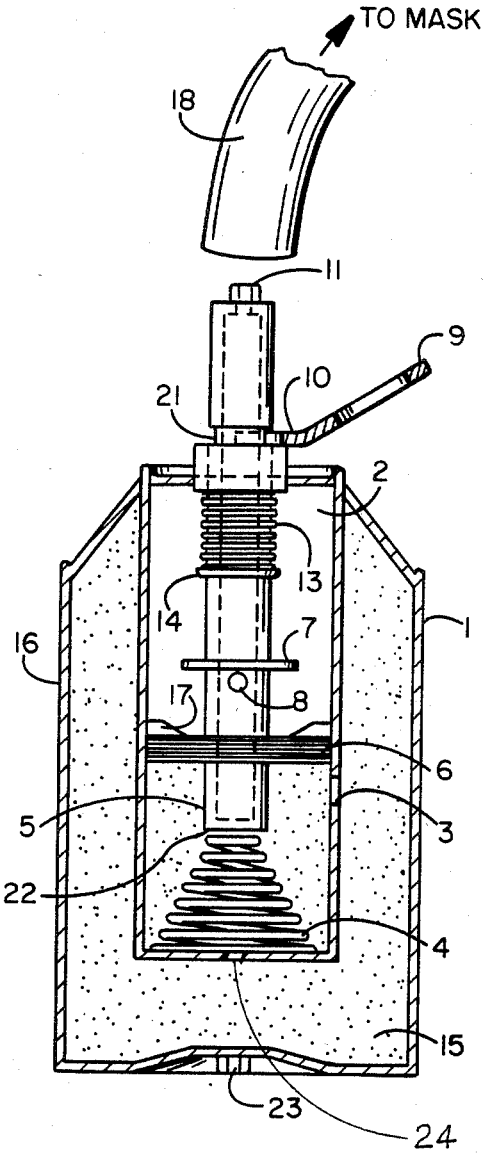
Figure 3:
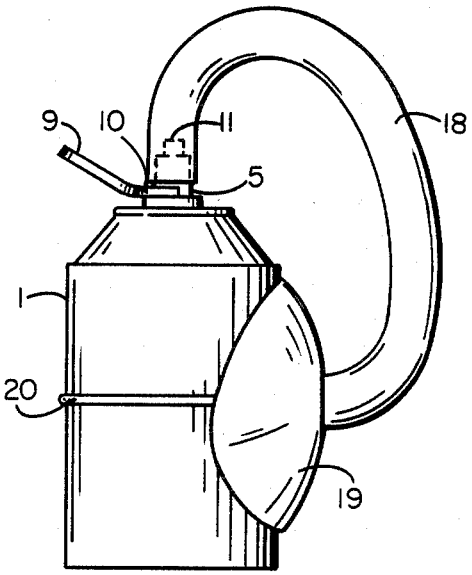

1. Canister
2. Canister inner Chamber
3. Inner Chamber Aperture
4. Spring
5. Plunger unit tube
6. Seal ring
7. Locking Collar
8. Inlet Aperture
9. Snap ring pull handle
10. Snap ring section 11. Aperture to hose
13. Spring (compressed)
14. Shoulder
15. Breathable gas
16. Main Cylinder
17. Lock ring
21. Groove in plunger unit
22. Bottom end of plunger unit tube
23. Gas filler valve
24. Aperture in bottom of canister inner chamber FIG. 2. This is an elevation view of internal mechanism of the canister in use wherein:

1. Canister
2. Canister inner Chamber
3. Aperture
4. Spring
5. Plunger unit tube
6. Seal ring
7. Locking Collar
8. Inlet aperture
11. Aperture to hose
12. Retaining ring
13. Spring (activated)
14. Shoulder
15. Breathable gas
17. Lock ring
18. Hose
22. Bottom end of plunger unit tube
23. Gas filler valve
24. Aperture in bottom of canister inner chamber FIG. 3 is an elevation view of the canister, hose and face mask in storage position.

Figure 4:
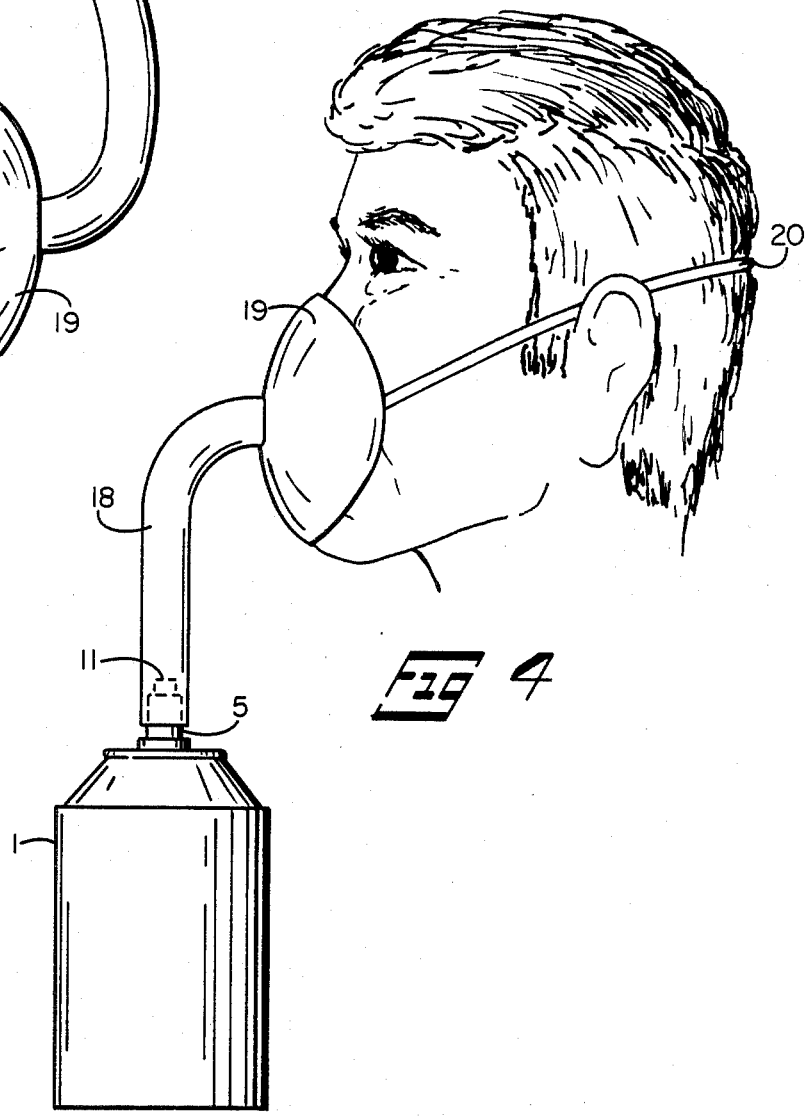
Figure 5:
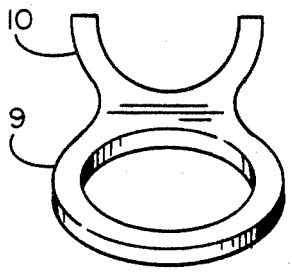

1. Canister
5. Plunger Unit Tube
9. Snap ring pull-handle
10. Snap ring section
11. Aperture to hose
18. Hose
19. Mask (nose and mouth)
20. Elastic band FIG. 4 is an elevation view of the canister hose and mask in position of use wherein:

1. Canister
5. Plunger Unit Tube
11. Aperture to hose
18. Hose
19. Mask (nose and mouth)
20. Elastic band FIG. 5 is a plan view of snap ring pull-handle and snap ring wherein:

9. Snap ring finger pull-handle
10. Snap ring section

DESCRIPTION OF THE INVENTION

Certain terminology will be used in the following description for convenience in reference only and will not be limiting. The words "down" and "up" will designate position or travel of plunger unit tube "down" into the canister or "up" in the held position. Breathable air-gas will designate gas in the canister. Canister can be described as a cylinder, and since the term cylinder is well known, the drawings show only elevation view of the canister or cylinder. Terminology will include the words specifically mentioned above, derivatives thereof and words of similar import, and this will include aperture equivalent to orifice.

A brief description of the invention is as follows.

This invention discloses a disposable smoke mask 19 and apparatus comprising breathable gas or air 15, contained under pressure in a canister 1, connected by a hose 18, to said mask 19, and wherein said breathable gas 15, contained in said canister 1, is released from said canister 1, to said hose 18, by means of a plunger unit tube 5, actuated by removal of a snap ring section 10, to allow a spring under compression 13, to actuate said plunger unit tube 5, to allow said breathable gas 15, to flow through inner chamber aperture 3, in the canister inner chamber wall of said canister 1, and into inlet aperture 8, in said plunger unit tube 5, and out of said plunger unit tube 5, through aperture to hose 11, into said hose 18, and to said mask 19.

A more detailed description of the invention follows.

This invention of a disposable smoke mask and apparatus comprises a face mask fitting over only the nose and mouth of a wearer and said mask is connected by a suitable hose to a canister 1, containing breathable gas or air. Canister 1 comprises main cylinder 16, canister inner chamber 2 and plunger unit tube 5 contained in the canister inner chamber 2, and inner chamber aperture 3. Spring 4 is positioned on the bottom of canister inner chamber 2, and serves to hold the bottom end of plunger unit tube 5. Seal ring 6 mounted firmly on plunger unit tube 5, and in contact with the inner surface of canister inner chamber 2, and also in contact with lock ring 17, serves to prevent leakage of the gas 15 from the container 1. Locking collar 7 is flexible fastened gas tight to plunger unit tube 5 and is above inlet aperture 8 of plunger unit tube 5.

Gas filler valve 23, is positioned in the recess of the bottom of canister 1. This valve can be conventional valve such as tire valve or a globe type valve.

Snap ring section 10 is connected to snap ring pull handle 9. Snap ring section 10 serves to hold plunger unit tube 5 in its up position as opposed to its down position in FIG. 2.

Snap ring 10 can be described as a half circle as shown in FIG. 5.

The plunger unit tube 5 is held in the up position by snap ring 10 fitting in a groove 21 in plunger unit tube 5 and held in said groove 21 between retaining ring 12 and top section of plunger unit tube 5 above said groove. A suitable groove 21 is positioned on plunger unit tube 5 so that snap ring section 10 fits therein to hold the plunger unit tube 5 so that snap ring section 10 fits therein to hold the plunger unit tube 5 in the up or closed position. Spring 13 is compressed under maximum compression when snap ring section 10 is in groove 21. Spring 13 is under maximum compression as stated above, and exerts a force against shoulder 14 on plunger unit tube 5 and the other end of spring 13 is against retaining ring 12, mounted on canister inner chamber 2. Canister inner chamber 2 is sealed on the top, around retaining ring 12.

Plunger unit tube 5 is an elongated hollow tube shape, closed at the bottom end 22 and having inlet aperture 8 extending through the tube wall of plunger unit tube 5.

Aperture 11 is located at the top end of plunger unit tube 5, and extends into one end of hose 18, leading to mask 19.

Figure 2:
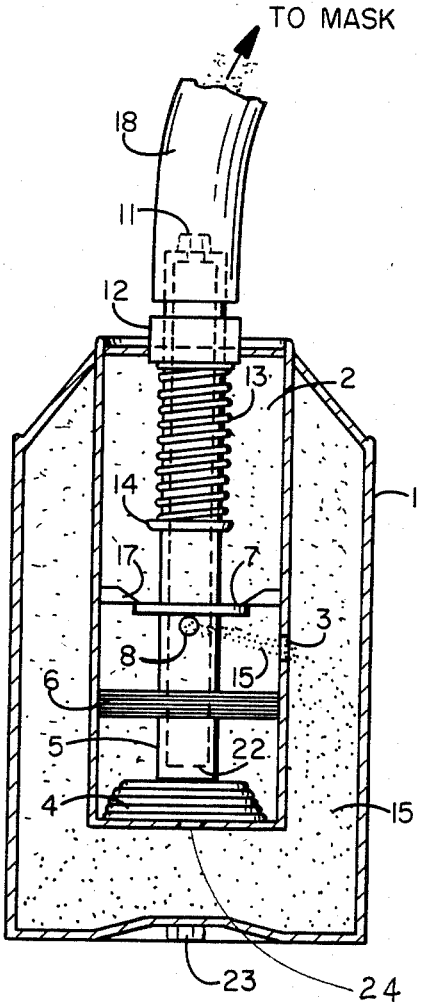

For operation of the canister apparatus snap ring finger pull-handle 9 when pulled from the canister 1, pulls snap ring 10 out of groove 21 in plunger unit tube 5, spring 13 is released from its compression and forces plunger unit tube 5 downward. By downward is meant the plunger unit tube 5 is forced into the canister 1, as shown in FIG. 2. The spring 13 exerts a force against shoulder 14 on plunger unit tube 5, and when the plunger is in the down position as shown in FIG. 2, breathable gas 15, from main cylinder 16, flows through inner chamber aperture 3, and into inlet aperture 8 in plunger unit tube 5 and out of aperture 11 to hose 18, through said hose to face mask 19, held over a person's mouth and nose by elastic band 20.

Seal ring 6 is rigidly fastened in a gas tight manner on plunger unit tube 5.

Lock ring 17 is fastened in a gas tight manner to canister inner chamber.

Vent 24 in bottom of canister inner chamber 2 vents gas into the canister when plunger unit tube 5 is forced downward by spring 13.

Locking collar 7 fastened in a gas tight manner to plunger unit tube 5.

It is to be pointed out, as shown in FIGS. 1 and 2, that the inner diameter of lock ring 17 is sloped downward so that on release of plunger unit tube 5, which is forced downward by compression spring 13, locking collar 7 is forced through the opening of lock ring 17, and comes to rest on the downward or underside of lock ring 17.

Having described our invention, we claim.

1. Disposable smoke mask and apparatus comprising a smoke mask and canister of breathable gas wherein the improvement comprises:

a. a canister of breathable gas including an inner chamber;
b. plunger unit tube mounted in said canister;
c. said plunger unit tube held in position to seal said breathable gas in said canister, by means of a compressed spring and a snap ring fitting in a groove in said plunger unit tube;
d. seal ring rigidly fastened in a gas tight manner on said plunger unit tube;
e. lock ring fastened in a gas tight manner to said canister inner chamber, and wherein the inside diameter of said ring is sloped downward;
f. locking collar fastened in a gas tight manner to said plunger unit tube;
g. an aperture leading from said inner chamber;
h. an aperture in plunger unit tube located between said seal ring and said locking collar;
i. an aperture in top of plunger unit tube;
j. a hose end connected to said aperture in top of said plunger unit tube;
k. opposite end of said hose connected to said face mask;
l. said face mask including an elastic band.

* * * * *